US005269111A

United States Patent [19]

McDougall

[11] Patent Number: 5,269,111

[45] Date of Patent: Dec. 14, 1993

[54] DOOR

[75] Inventor: Bryan G. McDougall, Eastwood, United Kingdom

[73] Assignee: Leaderflush Doors Limited, Nottingham, England

[21] Appl. No.: 743,699

[22] Filed: Aug. 12, 1991

[51] Int. Cl.[5] ..... E04B 2/28

[52] U.S. Cl. ..... 52/455; 49/171; 49/501

[58] Field of Search ..... 52/455–459, 52/308, 788, 802–809, 790, 397, 398, 823; 49/171, 501, 504

[56] References Cited

U.S. PATENT DOCUMENTS

| | | | |
|---|---|---|---|
| 1,183,842 | 5/1916 | Alling | 52/802 |
| 1,185,145 | 5/1967 | Fenton . | |
| 1,421,645 | 10/1973 | Eckel . | |
| 1,749,237 | 3/1930 | Weinstein | 49/171 |
| 2,649,171 | 8/1952 | Persson | 52/823 |
| 2,817,399 | 12/1957 | Donaldson et al. | 52/222 |
| 2,828,235 | 3/1958 | Holland et al. | 52/790 |
| 4,027,443 | 6/1977 | Briggs | 52/398 |
| 4,132,042 | 1/1979 | Di Maio | 52/809 |
| 4,850,168 | 7/1989 | Thorn | 52/805 |

FOREIGN PATENT DOCUMENTS 0006231 9/1979 Fed. Rep. of Germany .

*Primary Examiner*—James L. Ridgill, Jr.
*Attorney, Agent, or Firm*—Lorusso & Loud

[57] ABSTRACT

A door having a door core construction having a front face and a rear face which are both planar, and at least one window opening formed in said front and rear faces, both the front face and the rear face being entirely covered by a transparent covering layer.

In an alternative embodiment the door construction may comprise a door core having at least one aperture extending between a front and rear surface of the door core, the aperture being closed by a pair of panes, one pane being mounted so as to have an outer surface contiguous with the front surface of the door core and the other pane being mounted so as to have an outer surface contiguous with the rear surface of the door core, a front and rear surface covering layer covering the front and rear surfaces respectively of the core and having an aperture of smaller dimensions than the pane mounted in the surface covered thereby so that the peripheral margin of said pane is also covered by said covering layer.

15 Claims, 3 Drawing Sheets

DOOR

The present invention relates to a door construction.

In certain environments it is desirable for doors to have a glazed window opening in order to enable personnel to see through to the other side of the door. However, in installations where a sterilised or dust free environment is required, e.g. hospitals or laboratories, the provision of a glazed window opening presents problems since conventional glazed constructions based upon rebates and beadings create dust traps and are difficult to clean.

It is a general aim of the present invention to provide a glazed door construction which overcomes these disadvantages.

According to one aspect of the present invention there is provided a door having a door core construction having a front face and a rear face which are both planar, and at least one window opening formed in said front and rear faces, both the front face and the rear face being entirely covered by a transparent covering layer.

According to another aspect of the present invention there is provided a door construction comprising a door core having at least one aperture extending between a front and rear surface of the door core, the aperture being closed by a pair of panes, one pane being mounted so as to have an outer surface contiguous with the front surface of the door core and the other pane being mounted so as to have an outer surface contiguous with the rear surface of the door core, a front and rear surface covering layer covering the front and rear surfaces respectively of the core and having an aperture of smaller dimensions than the pane mounted in the surface covered thereby so that the peripheral margin of said pane is also covered by said covering layer.

Preferably the covering layers are formed from a plastics sheet or laminated resin sheet such as Formica (registered trade mark) which are bonded to the front and rear surfaces. The covering layers in this embodiment are preferably chosen to be relatively thin, eg 0.5 or 0.8 mm, so that its edges form a very narrow shoulder adjacent said panes which are relatively easily cleaned. These edges may or may not be chamfered. The door therefore has a substantially flush appearance.

Various aspects of the present invention are hereinafter described with reference to the accompanying drawings, in which.

The door illustrated in the Figures includes a core construction 10 which has a front planar face 12 and a rear planar face 14. A pair of glazed openings 16 are formed in the core construction 10.

Figure 1:
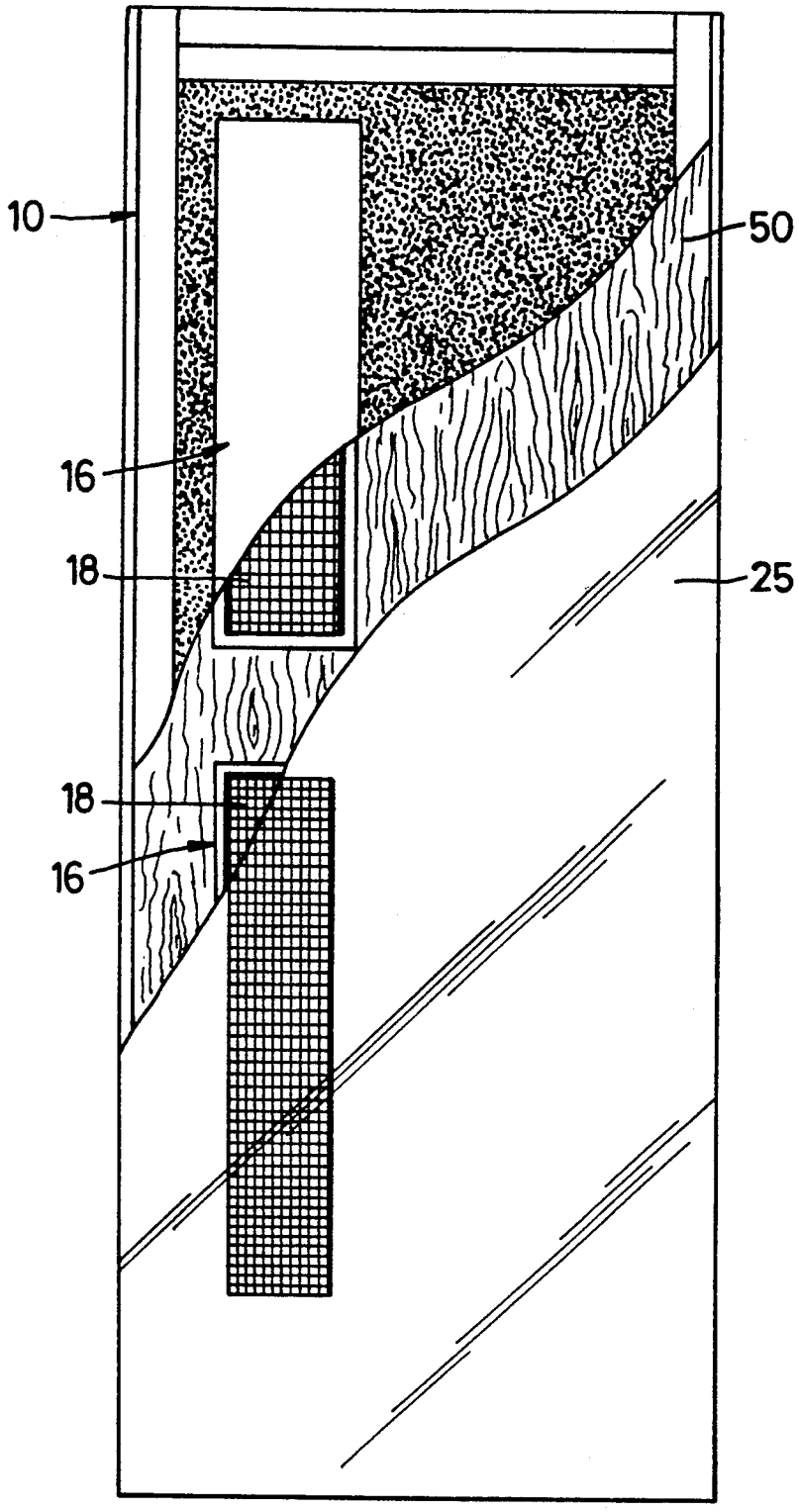
FIG. 1 is a front view, partly broken away, of a door according to a first embodiment of the present invention.
Figure 2:
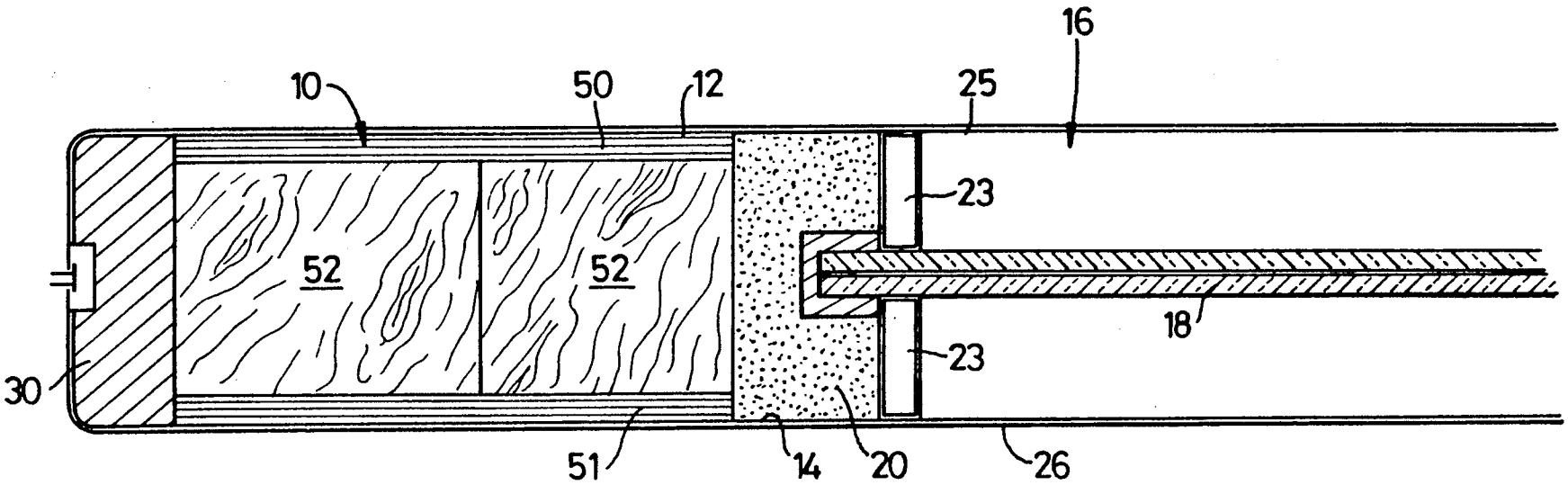
FIG. 2 is a part cross-sectional view of the door shown in FIG. 1.

As seen in greater detail in FIG. 2, each opening 16 includes a pane of glass 18 which is located inboard of the front and rear faces 12,14. The pane of glass 18 may be held in position by conventional means provided that retention means such as beadings do not project beyond the surface of faces 12,14.

In the illustrated embodiment the pane of glass 16 is held in a U-shaped channel members 20 formed of an incombustible material and is bonded on each side by intumescent strips 23.

A transparent covering layer 25 extends across the entire surface of front face 12 and a similar transparent covering layer 26 extends across the entire surface of the rear face 14. Preferably each covering layer 25,26 extends to wrap around and onto the side edge 30 of the door core construction.

The transparent covering layers 25,26 are preferably bonded to the front and rear faces 12,14 respectively using a suitable adhesive. Preferably the adhesive is a clear adhesive.

The covering layers 25,26 are preferably formed from any desirable clear plastics material such as polyvinyl chloride and are typically about 1.5 mm thick.

Prior to bonding to the front and rear faces 12,14 the internal face of each covering layer may be coated with a suitable paint or ink to provide a desirable colour and/or indicia which will be visible on the completed door. The areas on the covering layer corresponding to the openings 16 would be left uncovered by the paint or ink.

The door construction above includes a pane of glass in each opening 16. It will be appreciated that the pane of glass may be omitted so that the window opening is effectively glazed by the covering layers 25,26. As an alternative, the opening 16 may be glazed using more than one pane of glass.

The core construction of the door may vary and be of any conventional construction. In the illustrated embodiment plywood sheets 50,51 are provided which encase side by side blocks 52 of non combustible material.

The above construction of door provides flush outer surfaces which are easily cleaned and do not present indented surfaces which could provide dust traps.

Figure 3:
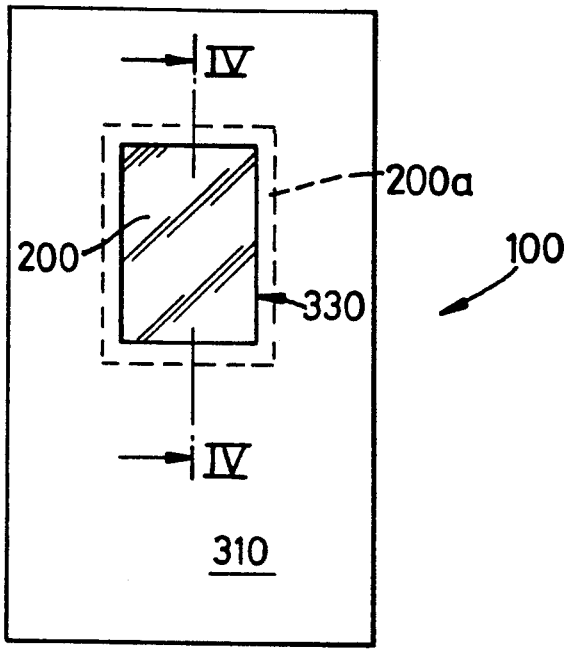
FIG. 3 is a schematic front view of a door construction according to a second embodiment of the present invention.
Figure 4:
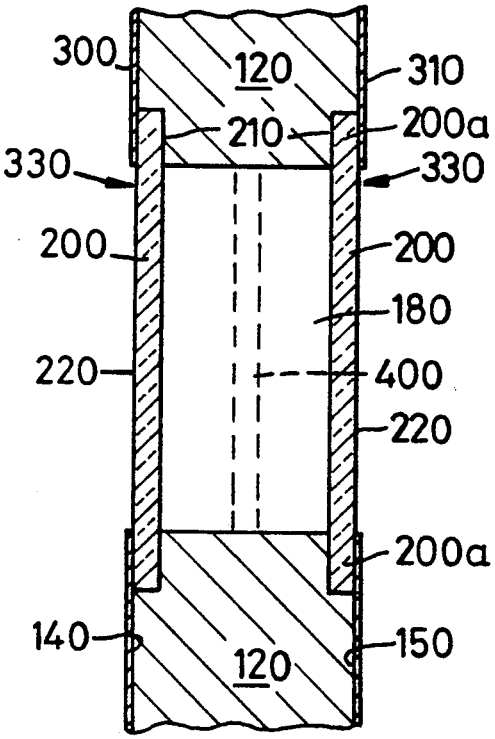
FIG. 4 is a cross-sectional view of the door construction taken along line II-II in FIG. 1.

An alternative embodiment is illustrated in FIGS. 3 and 4, wherein the covering layer does not entirely cover the aperture.

The door construction 100, shown in FIGS. 3 and 4, includes a door core 120 which may be of any conventional construction. The door core 120 has a front surface 140 and a rear surface 150, both of which may be defined by a sheet material such as plywood.

The door core 120 is provided with at least one aperture 180 which extends between the front and rear surfaces 140, 150.

The aperture 180 is glazed at each end by a pane 200 which is located in a rebate 210 so that the outer face 220 of the pane is contiguous with the adjacent surface 140 or 150.

The pane 200 may be formed from glass or a clear plastics material.

A covering layer 300, 310 is bonded to the front and rear surfaces 140,150 respectively. The covering layer 300,310 includes an aperture 330 which is positioned so as to be in registry with aperture 180 when bonded to the door core. The aperture 330 has smaller dimensions than pane 200 so that the covering layers 300, 310 also covers and is bonded to the peripheral margin 200*a* of the pane. Thus any gaps between the edges of the pane and the accommodating rebate 210 are sealingly isolated from the external environment. Preferably the dimensions of the aperture 330 are chosen to be substantially the same as the dimensions of aperture 180.

The thickness of the covering layers 300, 310 is preferably chosen to be relatively thin, say less than 1.0 mm, eg 0.5 mm or 0.8 mm such that only small shoulders are produced by the edges of the covering layer defining apertures 330. The covering layers 300,310 are preferably formed from a plastics sheet or a laminated resin sheet such as Formica (RTM). Since the covering layer 30,31 does not entirely cover the aperture 330 it will be appreciated that the covering layer may be opaque or transparent.

If desired, an additional pane 400 may be located in aperture 180 in order to provide fire resistance. Such a pane 400 would be mounted in a conventional manner in say a non combustible surround and would be formed from a wire reinforced glass.

I claim:

1. A door having a door core construction comprising a planar front face defined by a first sheet material and a planar rear face defined by a second sheet material, and at least one window opening passing through the core construction and said front and rear faces, both the front face and the rear face being entirely covered by a transparent covering layer formed from a clear plastics material.

2. A door according to claims 1, wherein each covering layer extends to wrap around and onto the side edges of the door core construction.

3. A door according to claim 1, wherein the window opening includes a pane of glass located inboard of the front and rear faces.

4. A door according to claim 3, wherein the pane of glass is located in U-shaped channel members formed of an incombustible material.

5. A door according to claim 1, wherein each covering layer is formed from a clear plastics material which is about 1.5 mm thick.

6. A door according to claim 5, wherein each covering layer is bonded to a respective face of the door core construction by a clear adhesive.

7. A door according to claim 5, wherein the internal face of each covering layer is coated with a paint or ink to provide a desirable colour and/or indicia.

8. A door construction comprising a door core having at least one aperture extending between a front and rear surface of the door core, the aperture being closed by a pair of panes, one pane being mounted so as to have an outer surface contiguous with the front surface of the door core and the other pane being mounted so as to have an outer surface contiguous with the rear surface of the door core, a front and rear surface covering layer covering the front and rear surfaces respectively of the core and having an aperture of smaller dimensions than the pane mounted in the surface covered thereby so that the peripheral margin of said pane is also covered by said covering layer.

9. A door construction according to claim 8, wherein the covering layers are formed from a plastics sheet.

10. A door construction according to claim 8, wherein the covering layers are formed from a laminated resin sheet.

11. A door construction according to claim 8, wherein the thickness of each covering layer is less than 1.0 mm.

12. A door construction according to claim 8, wherein each of said panes is formed of glass.

13. A door construction according to claim 8, wherein each of said panes is formed of a clear plastics material.

14. A door construction according to claim 8, wherein an additional pane is located in said aperture to provide fire resistance.

15. A door construction according to claim 8, wherein each covering layer extends to wrap around and onto the side edges of the door core.

* * * * *